US007966837B2

(12) United States Patent
El-Galley et al.

(10) Patent No.: US 7,966,837 B2
(45) Date of Patent: Jun. 28, 2011

(54) AIR-CONDITIONING REGISTER ASSEMBLY AND METHOD

(75) Inventors: Rizk El-Galley, Birmingham, AL (US); Richard A. Campbell, Huntsville, AL (US); Joseph R. McGinty, Madison, AL (US)

(73) Assignee: Madina, LLC, Birmingham, AL (US)

( * ) Notice: Subject to any disclaimer, the term of this patent is extended or adjusted under 35 U.S.C. 154(b) by 976 days.

(21) Appl. No.: 11/692,535

(22) Filed: Mar. 28, 2007

(65) Prior Publication Data

US 2008/0242212 A1 Oct. 2, 2008

(51) Int. Cl.
*F25D 17/08* (2006.01)

(52) U.S. Cl. ..... 62/186; 62/177; 236/49.3

(58) Field of Classification Search ..... 62/186, 62/177; 236/49.3

See application file for complete search history.

(56) References Cited

U.S. PATENT DOCUMENTS

| | | | |
|---|---|---|---|
| 1,295,151 | A | 2/1919 | Frank |
| 1,743,994 | A | 1/1930 | Waterbury |
| 1,875,684 | A | 9/1932 | Waterbury |
| 1,886,841 | A | 11/1932 | Searles |
| 2,011,421 | A | 8/1935 | Searles |
| 2,043,934 | A | 6/1936 | Spear |
| 2,055,592 | A | 9/1936 | Reed |
| 2,679,202 | A | 5/1954 | Koff |
| 2,694,971 | A | 11/1954 | Andrews |
| 2,972,941 | A | 2/1961 | Bennett |
| 3,099,201 | A | 7/1963 | Gottlieb |
| 4,126,268 | A | 11/1978 | Vitale |
| 4,126,269 | A | 11/1978 | Bruges |
| 4,136,606 | A | 1/1979 | Wolbrink |
| 4,449,664 | A | 5/1984 | Mithuhira |
| D278,362 | S | 4/1985 | Rattray |
| 4,589,331 | A | 5/1986 | Villamagna |
| 4,722,266 | A | 2/1988 | Deckert |
| 4,738,188 | A | 4/1988 | Nishida |
| 4,754,697 | A | 7/1988 | Asselbergs |
| 4,809,593 | A | 3/1989 | Asselbergs |
| 4,846,399 | A | 7/1989 | Asselbergs |
| 4,852,470 | A | 8/1989 | Corriveau |

(Continued)

FOREIGN PATENT DOCUMENTS

| | | |
|---|---|---|
| JP | 2004308563 | 11/2004 |

*Primary Examiner* — Cheryl J Tyler
*Assistant Examiner* — Jonathan Bradford
(74) *Attorney, Agent, or Firm* — B. Aaron Schulman, Esq.; Jeffery Haeberlin, Esq.; Stites & Harbison PLLC

(57) ABSTRACT

A register assembly for augmenting the flow of conditioned air from a central air-conditioning unit to a room includes a fan, a temperature sensor, and a processing means. The fan is operably positioned for increasing air flow through the register assembly. The temperature sensor is for measuring a temperature of air in the register assembly and for outputting a measured temperature signal. The processing means is for: receiving the measured temperature signal; using the measured temperature signal in determining whether the central air-conditioning unit is providing conditioned air to the room; and activating the fan to augment the conditioned air flow if the central air-conditioning unit is providing conditioned air to the room. The processing means also provides drift compensation to prevent unwanted operation of the fan due to temperature drifts. The register assembly may include a rectangular housing positioned around the components for use in a floor vent, or a housing adapting a floor vent to a centrifugal, tower fan.

6 Claims, 12 Drawing Sheets

U.S. PATENT DOCUMENTS 5,029,451 A 7/1991 Imaiida
5,054,380 A 10/1991 Hubbard
5,097,674 A 3/1992 Imaiida
5,236,393 A 8/1993 Milewski
5,395,042 A * 3/1995 Riley et al. ..... 236/46 R
5,404,934 A 4/1995 Carlson
5,413,278 A 5/1995 Erikson
5,489,238 A 2/1996 Asselbergs
5,497,632 A 3/1996 Robinson
D370,969 S 6/1996 Ikeda
5,533,668 A 7/1996 Erikson
5,632,677 A * 5/1997 Elkins ..... 454/329
5,860,858 A 1/1999 Wettergren
5,910,045 A 6/1999 Aoki
6,196,469 B1 3/2001 Pearson
6,364,211 B1 4/2002 Saleh
6,468,054 B1 10/2002 Anthony
6,592,449 B2 7/2003 Cipolla
6,688,384 B2 2/2004 Eoga
7,168,627 B2 * 1/2007 Kates ..... 236/1 B
2005/0087614 A1 4/2005 Ruise
2006/0240764 A1 * 10/2006 Pierce et al. ..... 454/329

* cited by examiner 205
214
216
218
206
213
217
219
208
220
211
215

65
Entry
FLAG,0 =0?
N
66
Y
67
TEMP>TMAX?
Y
Set
TMAX=TEMP
69
N
68
TEMP<TMAX-n?
Y
Set
Flag,0
70
N
TMAX1=TMAX
71
TMIN=TEMP
72
PEAKCOUNT=3?
Increment
PEAKCOUNT
73
74
Clear FLAG,1
Set FLAG,2
75
Call Calc_diff
76
A
77

AIR-CONDITIONING REGISTER ASSEMBLY AND METHOD

BACKGROUND OF THE INVENTION

1. Field of the Invention

The present invention relates to the heating and cooling of living spaces. More particularly, this invention relates to an air-conditioning register assembly and method for augmenting the flow of conditioned air from a central air-conditioning unit to a room.

2. Description of Prior Art

Modern homes use central air-conditioning units to provide conditioned (heated or cooled) air for environmental control through a system of ducts and vents into the rooms of the homes. However, many homes end up with rooms that are not adequately controlled because the conditioned air being delivered through the ducts and vents in the room has an inadequate flow to support the thermal load. These "slow vents" often result from expansion of the living space, like a basement, garage, or attic or other unfinished area being converted into standard living space by the installation of insulation, sheetrock, carpet, and other materials used to create standard living spaces. Often, the homeowner or contractor connects the vents in the new living space to existing air-conditioning units within the home, resulting in inadequate flow of air to maintain a comfortable environment in the new living space. Other times, the home is constructed with very long runs on the supply ducts, again resulting in a "slow vent" within some rooms. Currently, the home owner has few options when these "slow vents" occur. They include the installation of a new central unit, changing the supply vent size to increase the flow, or adding a window air-conditioning unit to the room. (Often, this is a cooling option only, and additional heating elements have to be added to the room.)

BRIEF SUMMARY OF THE INVENTION

The invention described herein meets these needs and others, providing an air-conditioning register assembly and method for augmenting the flow of conditioned air from a central air-conditioning unit to a room. Advantageously, the system and method of the invention are independent of the central air-conditioning unit, and therefore do not have to be electrically attached to the central air-conditioning unit to control the fan when the central air-conditioning unit is delivering either heated or cooled air to the room.

Generally described, the invention is a register assembly and method for augmenting the flow of conditioned air from a central air-conditioning unit to a room. The register assembly includes at least one fan, a temperature sensor, and a processing means. The fan is operably positioned for increasing air flow through the register assembly. The temperature sensor is for measuring the temperature of air in the register assembly and for outputting a measured temperature signal. The processing means is for: receiving the measured temperature signal; using the measured temperature signal in determining whether the central air-conditioning unit is providing conditioned air to the room; and activating the fan to augment the conditioned air flow if the central air-conditioning unit is providing conditioned air to the room. The processing means may further use the measured temperature signal in determining whether the central air-conditioning unit is not providing conditioned air to the room, and deactivate the fan if the central air-conditioning unit is not providing conditioned air to the room.

According to one aspect of the invention, the processing means determines whether the central air-conditioning unit is providing conditioned air to the room by monitoring the measured temperature signal for a maximum value, a minimum value, and transition values characteristic of a conditioned air cycle, and determining whether the central air-conditioning unit is in a heating mode or a cooling mode. The processing means determines that the central air-conditioning unit is providing conditioned air to the room when the central air-conditioning unit is in a heating mode and the measured temperature signal transitions from a minimum value to a value that is a predetermined amount more than the minimum value, and when the central air-conditioning unit is in a cooling mode and the measured temperature signal transitions from a maximum value to a value that is a predetermined amount less than the maximum value. Further, the processing means determines that the central air-conditioning unit is not providing conditioned air to the room when the central air-conditioning unit is in a heating mode and the measured temperature signal transitions from a maximum value to a value that is a predetermined amount less than the maximum value, and when the central air-conditioning unit is in a cooling mode and the measured temperature signal transitions from a minimum value to a value that is a predetermined amount more than the minimum value.

More specifically, the processing means may determine whether the central air-conditioning unit is in a heating or cooling mode by: determining that the central air-conditioning unit is in a heating mode when the difference between the maximum value and a fixed ambient temperature value is greater than the difference between the minimum value and the fixed ambient temperature value; and determining that the central air-conditioning unit is in a cooling mode when the difference between the minimum value and the fixed ambient temperature value is greater than the difference between the maximum value and the fixed ambient temperature value.

According to another aspect of the invention, the processing means provides drift compensation to prevent unwanted operation of the fan due to long-term temperature drifts. More specifically, the processing means may provide drift compensation by: determining that the measured temperature signal is a value that has changed from the previous measured temperature signal value and that the previous measured temperature signal value had remained constant for a predetermined amount of time. If so, then: resetting the minimum temperature value to be the measured temperature signal value when the previous measured temperature signal value was the minimum temperature value and the measured temperature signal value is higher than the previous minimum temperature value; or resetting the maximum temperature value to be the measured temperature signal value when the previous measured temperature signal value was the maximum temperature value and the measured temperature signal value is lower than the previous maximum temperature value.

According to yet another aspect of the invention, the register assembly, further includes a rectangular housing, a screen, and a rectangular shaped top member. The rectangular housing is positioned around the fan, temperature sensor, and processing means, and has side walls, an upper flange extending outward along a top edge of the side walls, and a bottom flange extending inward along a bottom edge of the side walls. The bottom flange supports the fan. The side walls define a rectangular cavity. The screen is sandwiched between the bottom flange and the fan to prevent foreign objects from entering the fan while maximizing air flow. The rectangular shaped top member has a top flange extending outward from a top louvered surface and a rectangular boss extending below the top flange. The top flange mates with the housing upper flange. The rectangular boss mates with housing rectangular cavity.

Alternatively, the fan may be a centrifugal fan, and the register assembly may further include a housing positioned around the centrifugal fan, temperature sensor, and processing means. In this case, the housing adapts a floor vent to the centrifugal fan.

The invention will be better understood by reference to the following detailed description and the appended information.

DETAILED DESCRIPTION OF EXEMPLARY EMBODIMENTS OF THE INVENTION

Figure 1:
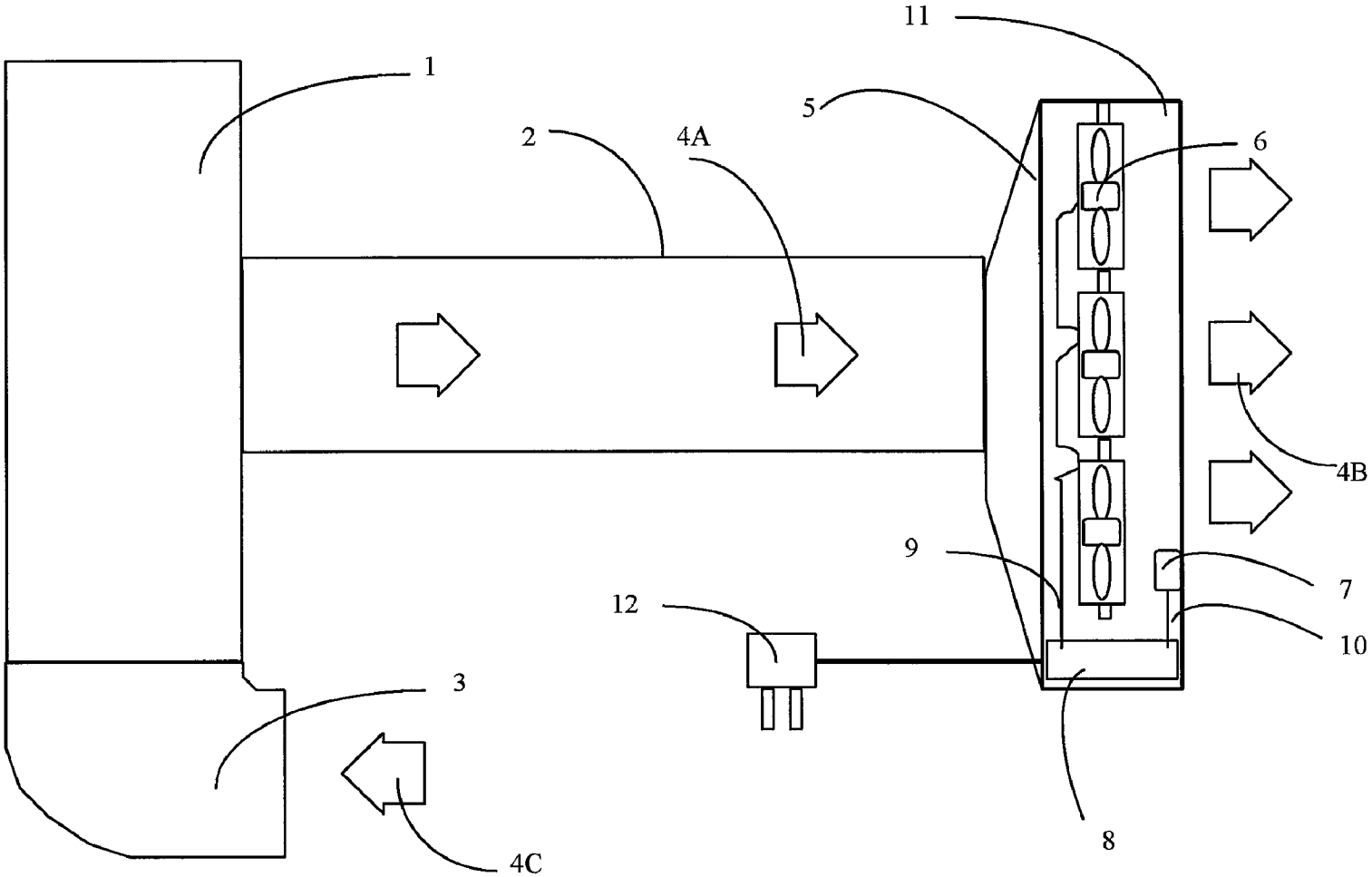
FIG. 1 is a functional block diagram of an exemplary central air-conditioning system utilizing an exemplary air-conditioner register assembly system and method according to the invention.

FIG. 1 is a functional block diagram of an exemplary central air-conditioning system for providing conditioned air to a room. The exemplary central air-conditioning system includes a central air-conditioning unit 1, a delivery duct 2, an air return duct 3, and an exemplary air-conditioning register assembly 5 according to the invention. The air-conditioning unit 1 is a heating and cooling furnace as might be used in a residence or business for climate control. The delivery duct 2 is a an enclosed passage for delivering conditioned (heated or cooled) air 4A from the air-conditioning unit 1 to the register assembly 5 and the room (not shown). The air return duct 3 is an enclosed passage for returning room air 4C to the air-conditioning unit 1 to be heated or cooled. The exemplary air-conditioning register assembly 5 delivers conditioned air 4B to the room.

The air-conditioning register assembly 5 is comprised of fans 6, a temperature sensor 7, a processing means 8, an housing 11 and a power supply 12. First connecting wires 9 connect the processing means 8 to the fans 6. Second connecting wires 10 connect the processing means 8 to the temperature sensor 7. The power supply 12 is operably connected to power the fans 6, the temperature sensor 7 and the processing means 8 for supplying all power needs to the air-conditioning register assembly 5. The fans 6 are mounted within the housing 11 to augment the flow of conditioned air 4A, 4B from the air-conditioning unit 1 through the register assembly 5 to the room. The temperature sensor 7 is an electronic temperature sensor that reads the temperature of the air in the register assembly 5. The processing means 8 is a microcontroller, microprocessor, or other appropriate processor that contains sufficient resources such as random access memory, input/output interfaces, and read only memory code storage cells and is capable of executing the steps of the method described herein. The housing 11 shown encloses the fans 6, temperature sensor 7, and processing means 8, and allows conditioned air 4A, 4B to flow through the air-conditioning register assembly 5.

Figure 2:
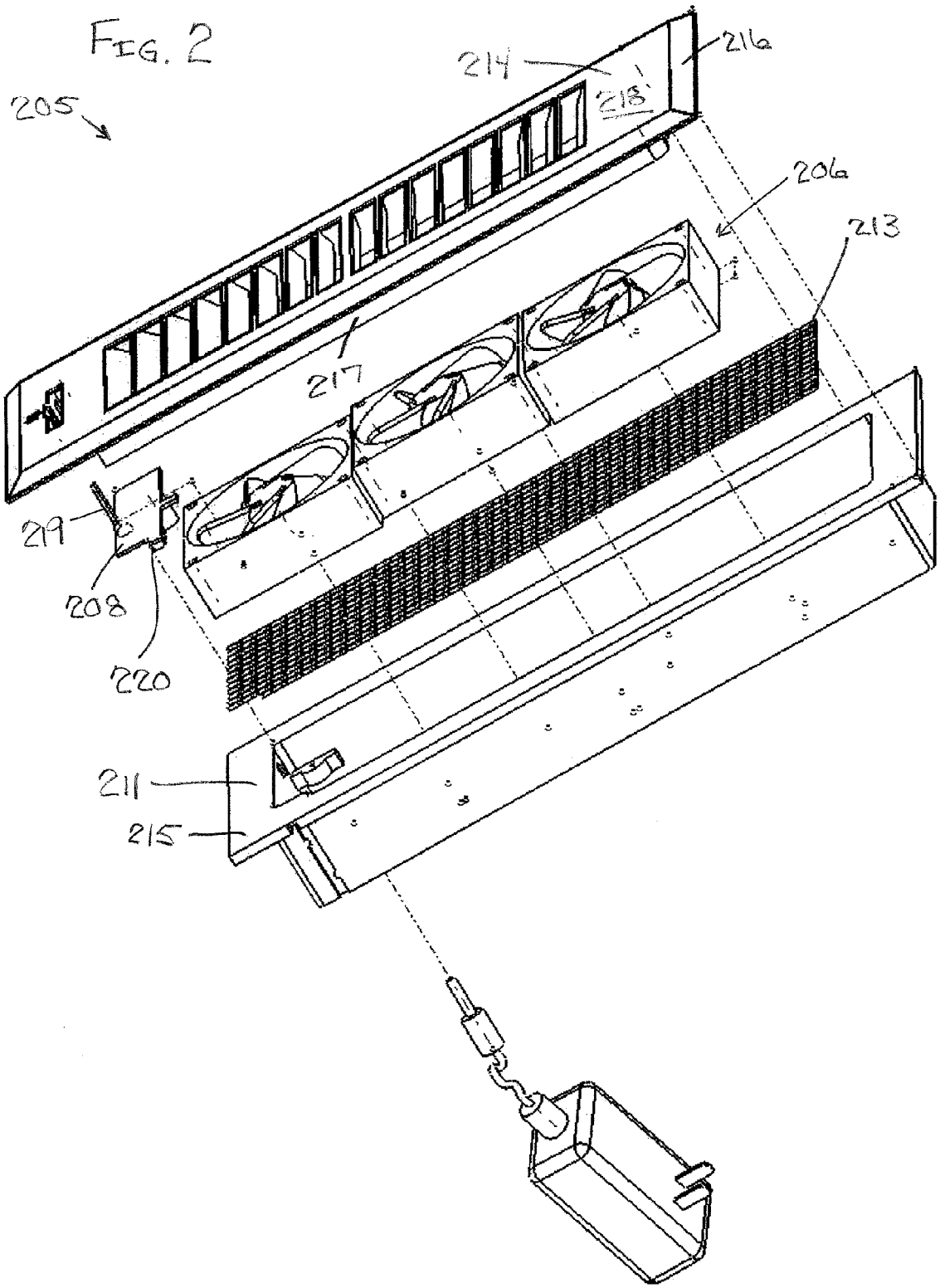
FIG. 2 is an exploded view of a first exemplary air-conditioning register assembly.

FIG. 2 is an exploded view of a first exemplary air-conditioning register assembly 205. The first exemplary air-conditioning register assembly 205 represents the configuration for a register assembly that would fit into a standard floor register's cut-out. The actual design of the register would be dictated by its intended use, i.e., floor, wall, or ceiling models. For example, the first exemplary air-conditioning register assembly 205 illustrated is a 4 inch×12 inch assembly that will fit into any cut-out that a standard 4×12 floor register would fit. This first exemplary air-conditioning register assembly 205 includes fans 206, a control module 208, and an housing 211. Also shown are a screen 213 and a top member 214.

The housing 211 is rectangular in shape, having rectangular side walls defining a rectangular cavity. The housing 211 has an upper flange 215 extending outward along a top edge. The upper flange 215 supports the register assembly 205 when it is located in a floor. The upper flange 215 has sufficient strength to support the register assembly 205 in the event that someone steps on the register assembly 205 while it is in the floor cavity. There is also a bottom flange (not shown) extending inward along the bottom edge. The bottom flange provides a mounting surface for both the screen 213 and the fans 206.

The screen 213 is sandwiched between the bottom flange and the fans 206. The screen 213 serves as a safety shield to prevent anyone from being injured by the rotating fan blades and to prevent foreign objects from damaging the fans 206. Selection of the screen material and the size of the openings is a design choice that one makes to satisfying the safety objectives.

The size, type and number of fans 206 are determined by the intended use of the exemplary register assembly 205. The selection of a specific fan is based on achieving the maximum air flow rate (standard cubic feet per minute ("CFM")) while being subjected to the size limiting constraints. The long and narrow shape of the first exemplary register assembly 205 requires one to utilize multiple small fans in order to achieve maximum flow rates. By connecting the fans 206 in parallel to the control module 208 there is a redundancy effect gained, since if one fan fails the others will still operate.

The control module 208 consists of a circuit board which incorporates a processor integrated circuit (not shown) which contains a control algorithm; multiple pairs of terminals for connecting fan wires, a temperature chip which measures the temperature of the air in the housing 211 at the exit surface of the fans 206; a switch 219 for setting the operational mode (on, off and automatic); and a receptacle for connection of the power supply 212.

The top member 214 is rectangular in shape with a top flange 216 on a top louvered surface 218. The dimensions of the top flange 216 are the same as the dimensions of the housing upper flange 215. The top flange 216 and the housing upper flange 215 mate together at assembly. A rectangular boss 217 extends below the top flange 216 and is sized to fit within a cavity defined by the housing 211. The top member 214 also defines a rectangular cavity that extends from the boss 217 to the top louvered surface 218.

Figure 3:
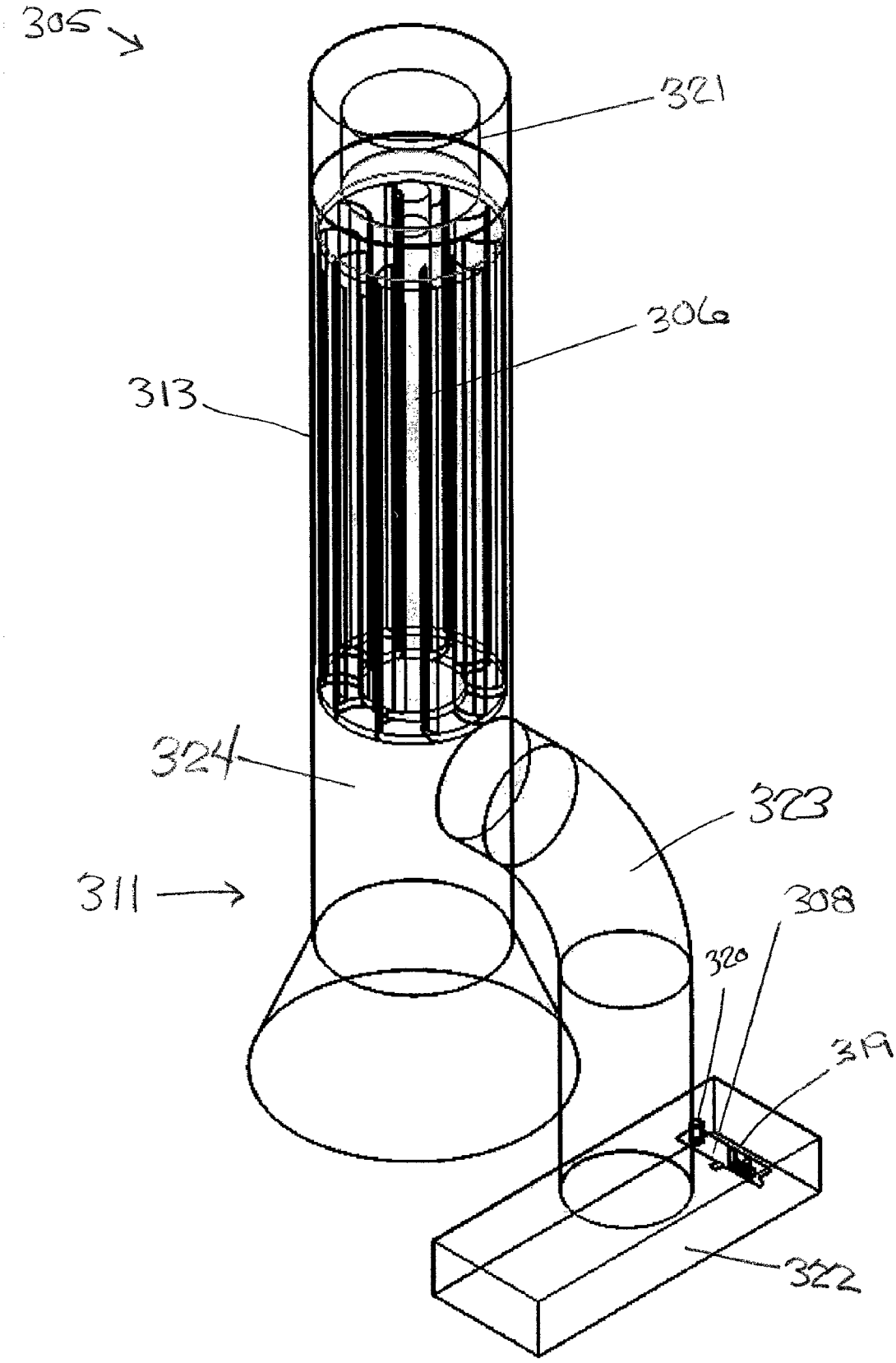
FIG. 3 is a perspective wire-frame view of a second exemplary air-conditioning register assembly.

FIG. 3 is a wire-frame side-view of a second exemplary air-conditioning register assembly 305. The second exemplary air-conditioning register assembly 305 represents a configuration that would adapt a standard floor register's cut-out to a tower-type fan assembly. As such, the second exemplary assembly 305 includes a centrifugal fan 306, a control module 308, and a housing 311. The centrifugal fan 306 is driven by a fan motor 320 that is operably connected to and controlled by the control module 308. The control module 308, similar to the control module 208 of the first exemplary assembly 205 (FIG. 2), consists of a board which incorporates an integrated circuit (not shown) as a processing means; circuitry for operating the fan motor 321; a temperature sensor which measures the temperature of the air in the register assembly 305; a switch 319 for setting the operational mode of the register assembly 305; and a receptacle 320 for connection of a power supply. The integrated circuit executes the control algorithm described below. The housing 311 has a floor vent adapting portion 322, a ducting portion 323, a tower fan portion 324, and a screen portion 313. The floor vent adapting portion 322 receives conditioned air from a floor vent and directs it into the ducting portion 323. The ducting portion 323 then directs the conditioned air into the tower fan portion 324 for forced distribution to the room through the screen portion 313.

Figure 4:
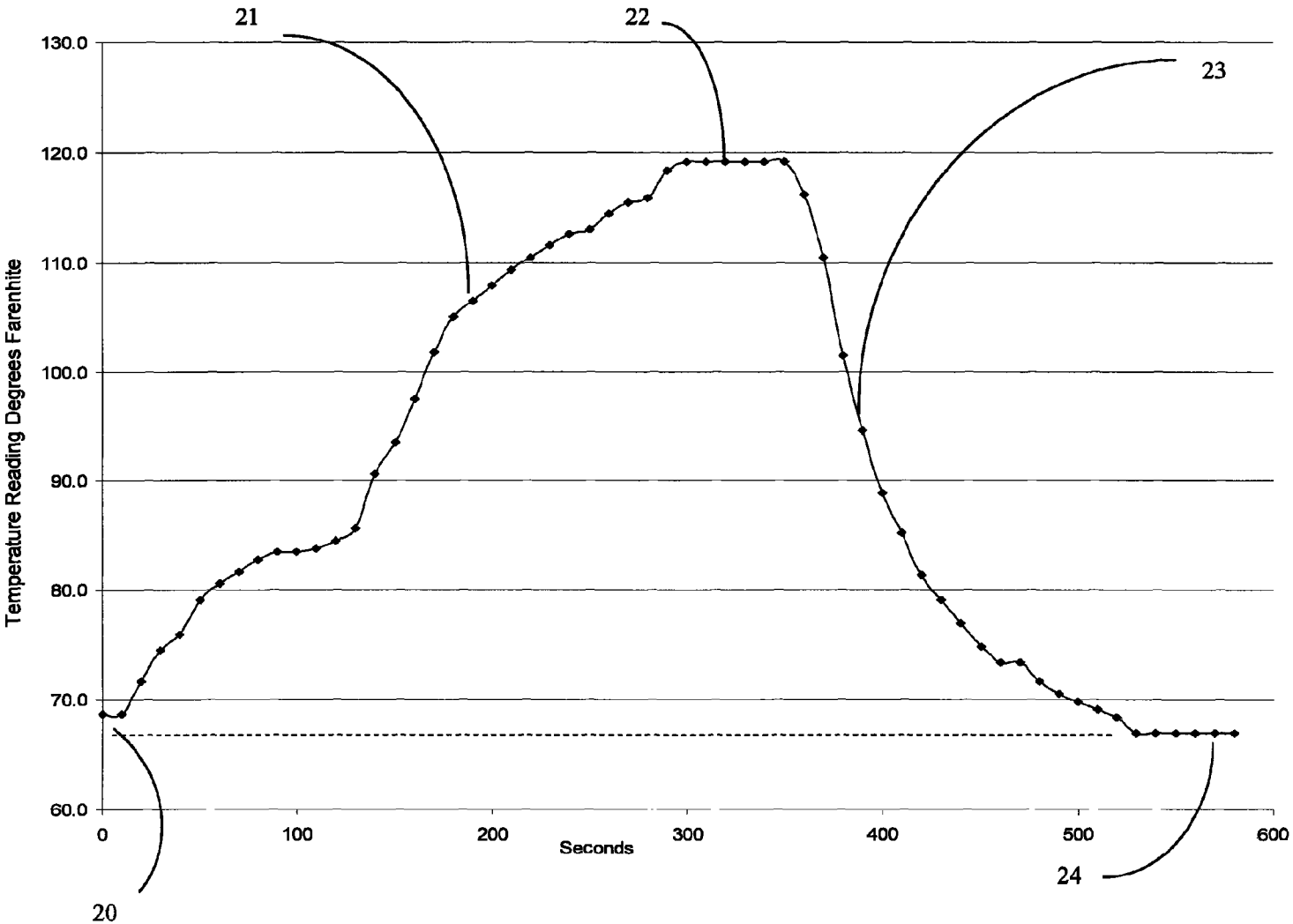
FIG. 4 is a graph of a measured temperature in an air-conditioning register for a heating cycle of an exemplary central air-conditioning unit.

FIG. 4 is a graph of a temperature in an air-conditioning register assembly 5 during a typical cycle of an air-conditioning unit 1 (see FIG. 1 for system element references for this paragraph) in a heating mode. Points 20 through 24 show various points on a typical measured temperature verses time plot for a standard air-conditioning unit 1 during a heating cycle. At time zero, point 20, the temperature is room ambient. The air-conditioning unit 1 begins to provide heated air to the register assembly 5. (It is important to note that this curve is the temperature of the conditioned air in the register assembly 5, and not the temperature of the mixed air within the room.) The rise in temperature is dramatic as shown by a temperature value of about one-hundred, seven degrees Fahrenheit at a second time, point 21 of approximately two-hundred seconds. At a third time, point 22, of approximately three-hundred seconds, the temperature of the air in the register assembly 5 reaches the steady state temperature of about one-hundred, nineteen degrees Fahrenheit. This temperature will be maintained by the air-conditioning unit 1 until the room thermostat reaches the desired temperature and turns off the air-conditioning unit 1. The air-conditioning unit 1 then continues to run the blower during a cool down shown at a fourth time, point 23. For the purpose of this description, the air provided during the cool down period shall not be considered to be conditioned air as defined herein. As the air-conditioning unit 1 cools, the temperature in the register assembly 5 reduces until the air-conditioning unit 1 turns off it's blower, and the register assembly temperature reaches the off steady state at a fifth time, point 24.

In operation, with reference to FIG. 1, the temperature sensor 7 measures the temperature of the air in the register assembly 5 and outputs a measured temperature signal to the processing means 8. The processing means 8 receives the measured temperature signal, determines that the central air-conditioning unit 1 is providing conditioned air to the room using the measured temperature signal, and activates the fans 6 to augment the flow of the conditioned air. Additionally, the processing means 8 further determines when the central air-conditioning unit 1 is not providing conditioned air to the room, and deactivates the fans 6.

The processing means 8 determines that the central air-conditioning unit 1 is providing conditioned air to said room by monitoring the measured temperature signal for a maximum value (Tmax), a minimum value (Tmin), and transition values characteristic of a conditioned air cycle (Tmax−n, Tmin+n); and determining whether the central air-conditioning unit 1 is in a heating mode or a cooling mode. The processing means 8 determines that the central air-conditioning unit 1 is providing conditioned air to said room when the central air-conditioning unit 1 is in a heating mode and the measured temperature signal transitions from a minimum value (Tmin) to a value that is a predetermined amount more than said minimum value (Tmin+n), and when the central air-conditioning unit 1 is in a cooling mode and the measured temperature signal transitions from a maximum value (Tmax) to a value that is a predetermined amount less than said maximum value (Tmax−n). The processing means 8 determines that the central air-conditioning unit 1 is not providing conditioned air to the room when the central air-conditioning unit 1 is in a heating mode and the measured temperature signal transitions from a maximum value (Tmax) to a value that is a predetermined amount less than said maximum value (Tmax−n), and when the central air-conditioning unit 1 is in a cooling mode and the measured temperature signal transitions from a minimum value (Tmin) to a value that is a predetermined amount more than said minimum value (Tmin+n). The processing means 8 determines whether the central air-conditioning unit 1 is in a heating mode or a cooling mode by determining that said central air-conditioning unit 1 is in a heating mode when the difference between the maximum value (Tmax) and a fixed ambient temperature value (Tamb) is greater than the difference between the minimum value (Tmin) and the fixed ambient temperature value (Tamb); and by determining that the central air-conditioning unit 1 is in a cooling mode when the difference between the minimum value (Tmin) and the fixed ambient temperature value (Tamb) is greater than the difference between the maximum value (Tmax) and the fixed ambient temperature value (Tamb). The value, "n," is a sensitivity factor that is utilized to positively establish that a state transition (on-to-off, or off-to-on) has occurred. For instance, a value of five-degrees Fahrenheit has been empirically derived to work well with most air-conditioning systems. However, the value of "n" could be adjusted for more or less sensitivity in identifying a transition.

The processing means 8 reads the temperature from the sensor 7 and executes program instructions to determine the lowest temperature (Tmin) and highest temperature (Tmax) of a air-conditioning cycle, and then determines when the central air-conditioning unit 1 transitions from on to off and from off to on using the sensitivity factor, "n". At these points it will turn on or off the fans 6 to provide maximum heating or cooling to the room.

Figures 5A, 5B:
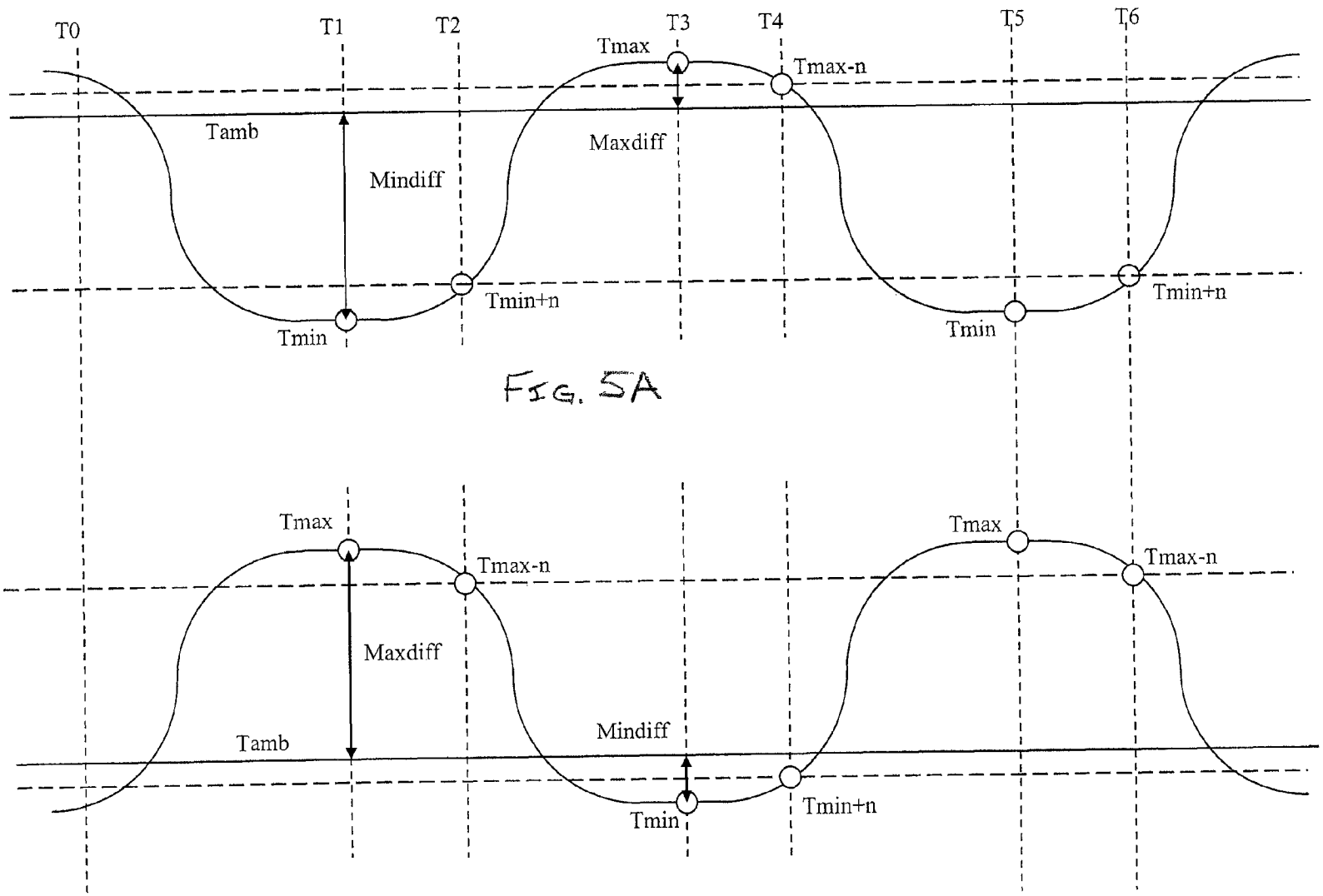
FIG. 5A is a graph of the operation of an exemplary air-conditioning register assembly for a cooling cycle.
FIG. 5B is a graph of the operation of an exemplary air-conditioning register assembly for a heating cycle.

FIG. 5A is a graph of the operation of the exemplary air-conditioning register assembly 5 for a cooling cycle. The processing means 8 reads the temperature approximately every 2 seconds. The processing means 8 first acquires three transition points. Immediately after the power is applied, the fans 6 are turned on continuously until the three points are "learned".

The time is plotted on the X axis, and the temperature within the register assembly 5 is plotted on the Y axis. At time T0, the air-conditioner unit 1 begins to provide cooled air to the register assembly 5. At time T1, the temperature stabilizes at its lowest point. The processing means 8 will continuously monitor and the temperature and continuously replace Tmin with any temperature that is lower. (This becomes a low peak detector, that is, the lowest temperature seen is stored in Tmin.) When the air-conditioning unit 1 stops cooling, the temperature within the register assembly 5 will begin to rise. At time T2, the temperature has risen n degrees above Tmin. At this point, the processing means 8 stores Tmin as the minimum, and recognizes that a transition has occurred and it needs to adjust the fans 6 accordingly. Thus the transitions occur as shown in FIG. 5A at times T2, T4, and T6. All that is now left to do is to determine if the fans should be turned on or turned off at each of these transition points.

FIG. 5B a graph of the operation of the exemplary air-conditioning register assembly 5 for a heating cycle, with transition points that correspond to the points of the cooling cycle of FIG. 5A.

At each transition point identified by the processing means 8, the processing means 8 calculates the difference between Tmax and Tamb (Fixed ambient temperature of 25 degrees centigrade) and also the difference between Tmin and Tamb. These differences are shown on FIGS. 5A and 5B as Maxdiff and Mindiff and are used to determine the action to be taken on the fans 6 at each transition point.

As shown in FIG. 5A, at transition T2, Mindiff is larger than Maxdiff indicating that the central air-conditioning unit 1 is in a cooling mode. Also, at transition T2, the measured temperature signal transitions from a minimum value (Tmin) to a value that is a predetermined amount greater than the minimum value (Tmin+n), indicating that the air-conditioning unit 1 has stopped providing cooled, conditioned air to the room. Therefore, the fans 6 should be turned off. Likewise, at transition T4, the fans 6 should be turned on.

Referring to FIG. 5B, at transition T2, Maxdiff is larger that Mindiff, indicating that the central air-conditioning unit 1 is in a heating mode. The transition at T2 is from a maximum value (Tmax) to a value that is a predetermined amount less that the maximum value (Tmax−n), indicating that the air-conditioning unit 1 has stopped providing heated, conditioned air to the room. Therefore, the fans 6 should be turned off. Likewise, at T4, the fans should be turned on.

As the cycles are repeated, Tmax and Tmin are continually updated, and only the last two points are used by the processing means 8. Thus, as the temperatures within the air-conditioning register assembly 5 changes, the processing means 8 compensates and continually monitors the temperature to derive the actions required to control the fans 6, completely independent of the air-conditioning unit 1.

Figure 6:
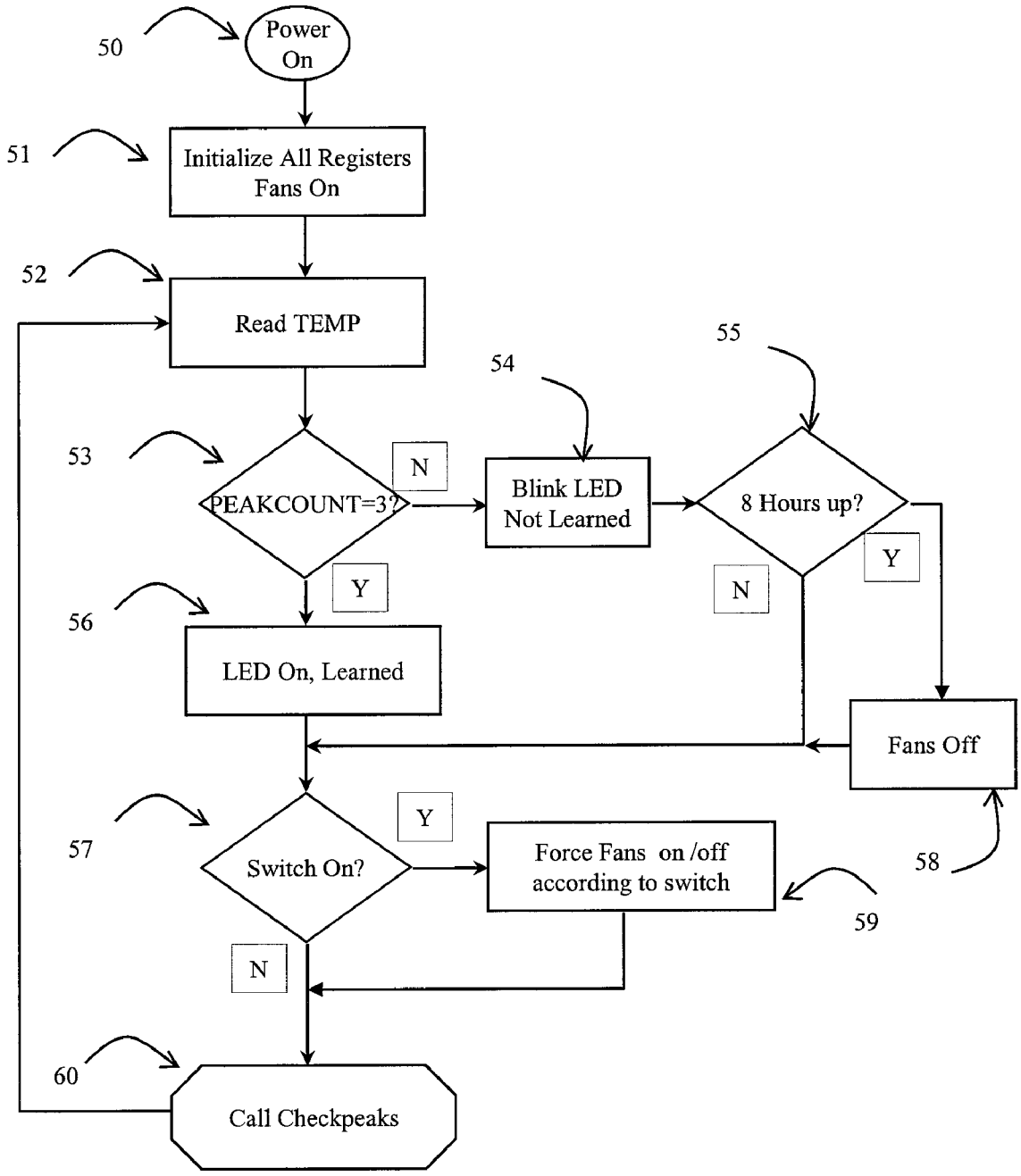
FIG. 6 is a high level software flowchart for executing the steps of a method according to the invention.

FIG. 6 is a high level software flowchart of the operation of the software program or algorithm executed by the processing means 8. On power-on 50, the algorithm initializes all variable and hardware interfaces in block 51. The fans 6 are forced "on." Temperature is read in block 52 about every 2 seconds. If the PEAKCOUNT is not three (three transition points have not been seen yet, and the algorithm has not "learned" the cycle characteristics.), the processing means 8 causes a Light Emitting Diode (LED) (not shown) to blink in block 54 to show "learning but not complete," and an eight hour timer is checked and incremented in block 55. If the eight hours are up, the fans 6 are turned off and stay off until the learning cycle is completed. If the learning cycle is accomplished in block 56, the eight hour timer is no longer active and the LED no longer blinks. A switch (not shown) is checked to see if the user has forced the fans 6 to "on" or "off," but the algorithm continues independent of the switch position.

Figure 7:
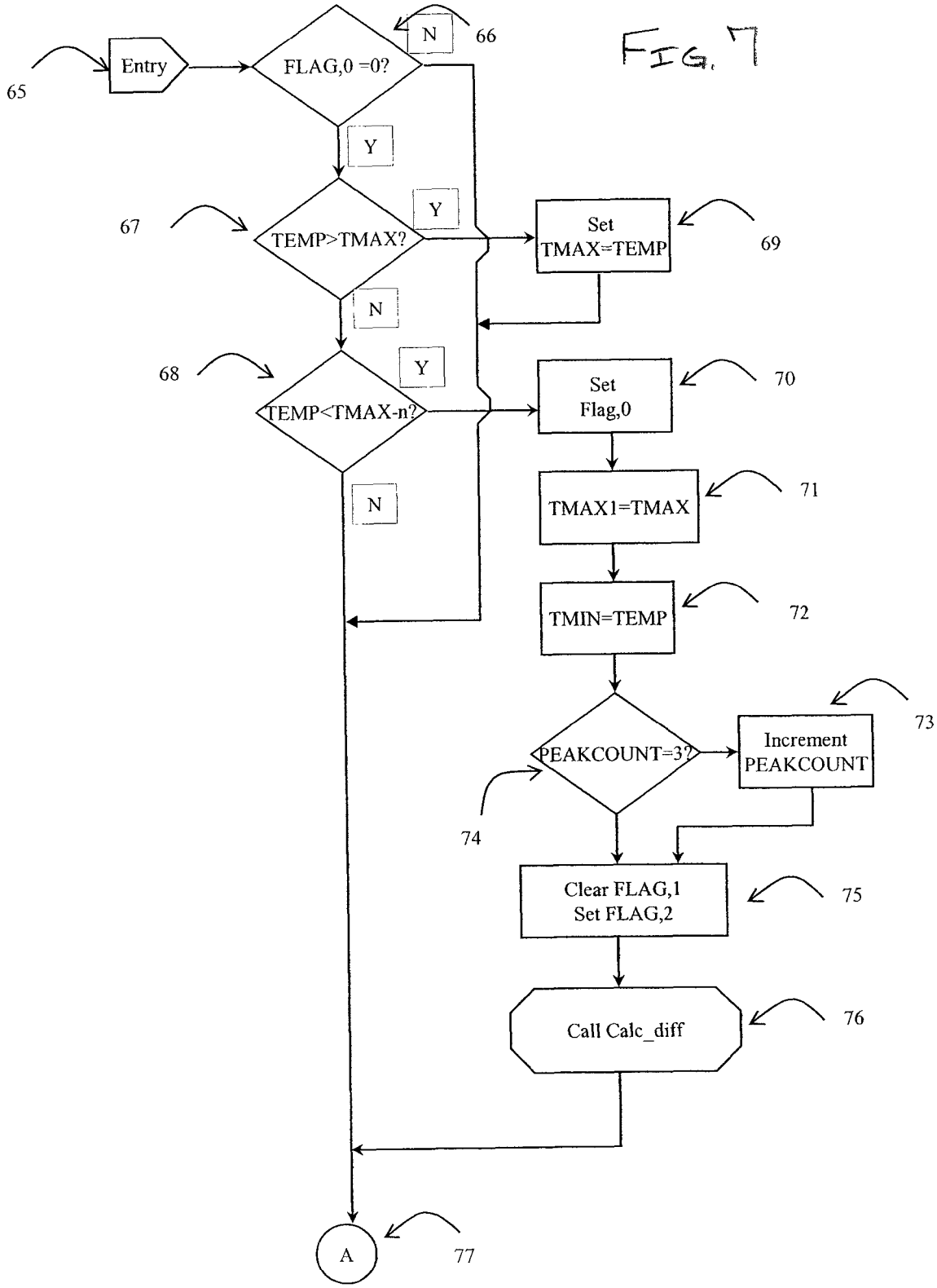
FIG. 7 is a flowchart of a first part of a Checkpeaks subroutine.
Figure 8:
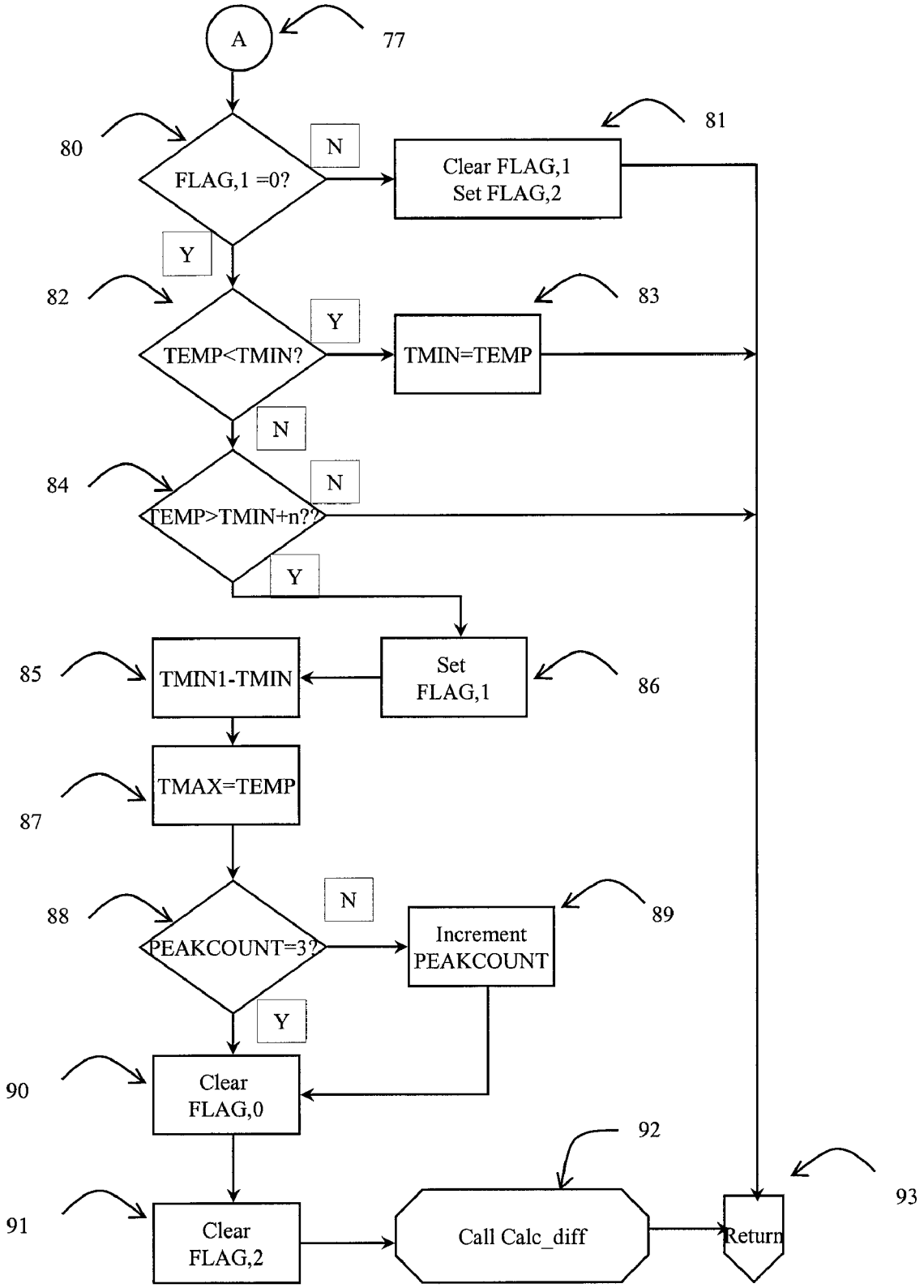
FIG. 8 is a flowchart of a second part of a Checkpeaks subroutine.

The Checkpeaks subroutine is called in block 60. FIG. 7 and FIG. 8 show the Checkpeaks Subroutine Flow chart. Referring to FIG. 7, block 66 looks at FLAG,0 to determine if the algorithm is looking for Tmax or Tmin. If Flag 0 is zero, it is looking for Tmax. If the Temp (Temperature read) is greater than Tmax block 67, Tmax is updated in block 69. If not, the temp is checked on block 68 to see if it less than the old value of Tmax−n. If yes, a transition has occurred, FLAG,0 is set, block 70, TMAX1, the stored value used by the algorithm, is updated, block 71, and Tmin is set to the current temperature value in block 72. This action resets the Tmin. The PEAKCOUNT is checked in block 74 and if not three, it is incremented, signifying a valid transition point has been "learned". FLAG,1 is cleared and FLAG,2 set in block 75, and then the Calc_diff Subroutine is called in block 76.

Referring to FIG. 8, block 80 checks FLAG,1 to see if the Tmin is being calculated. If it is not, block 81 clears FLAG, 1 and sets FLAG,2, the subroutine is complete and returns via block 93. If yes, the Temp is compared in block 82 to the Tmin. If it is less than Tmin, block 83 sets Tmin=Temp and returns via block 93. If not, the Temp is compared in block 84 to Tmin+n to see if a transition has occurred. If not, it returns via block 93, if yes, a transition did occur and FLAG,1 is set in block 86, Tmin1 is set to Tmin in block 85, and Tmax=Temp to reset Tmax. Again the PEAKCOUNT is checked in block 88 and incremented in block 89 if not a value of three. Then, FLAG,0 is cleared in block 90 and FLAG,2 is cleared in block 91. Calcdiff is called in block 92 and then the subroutine returns via block 93.

Figure 9:
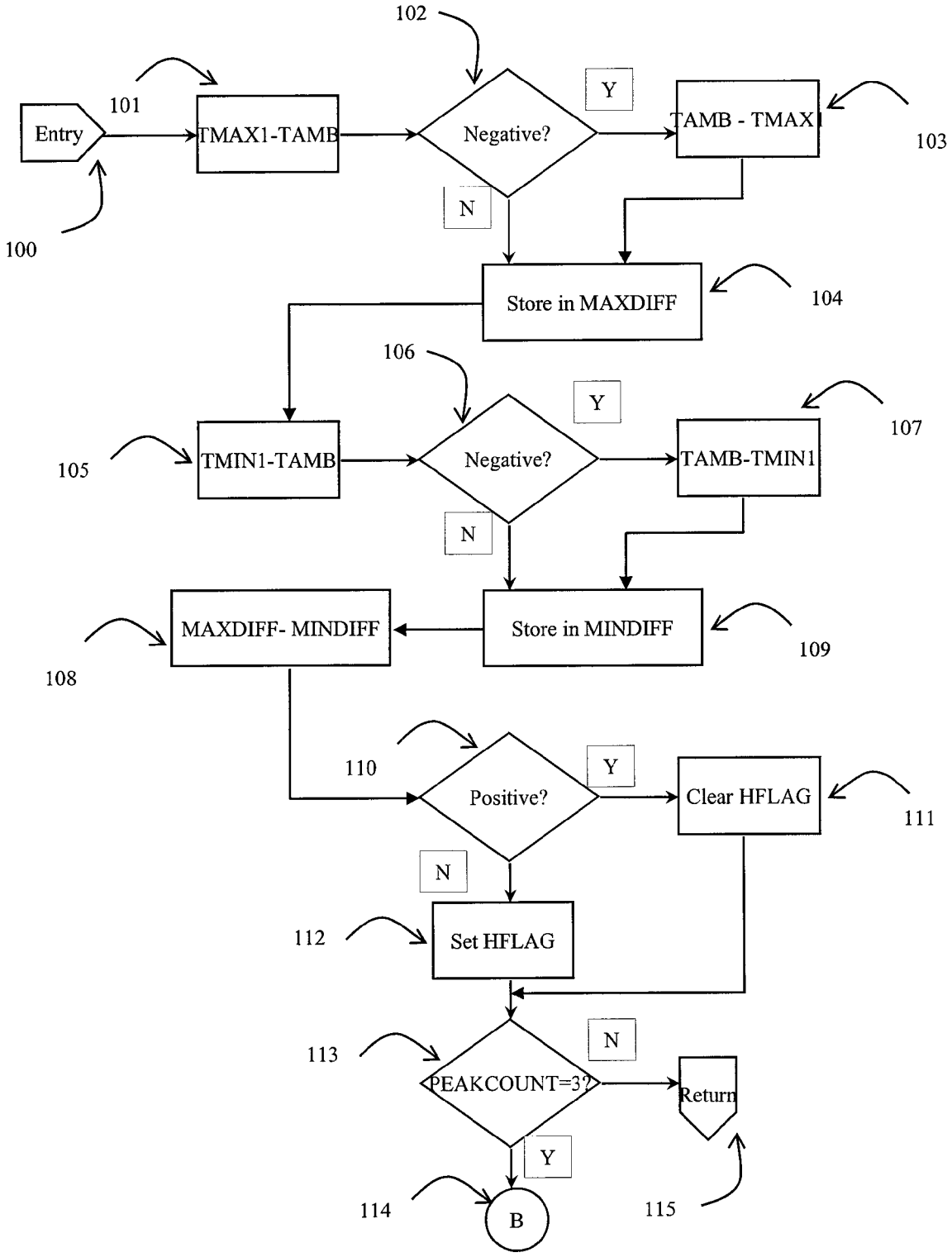
FIG. 9 is a flowchart of a first part of a Calcdiff subroutine.
Figure 10:
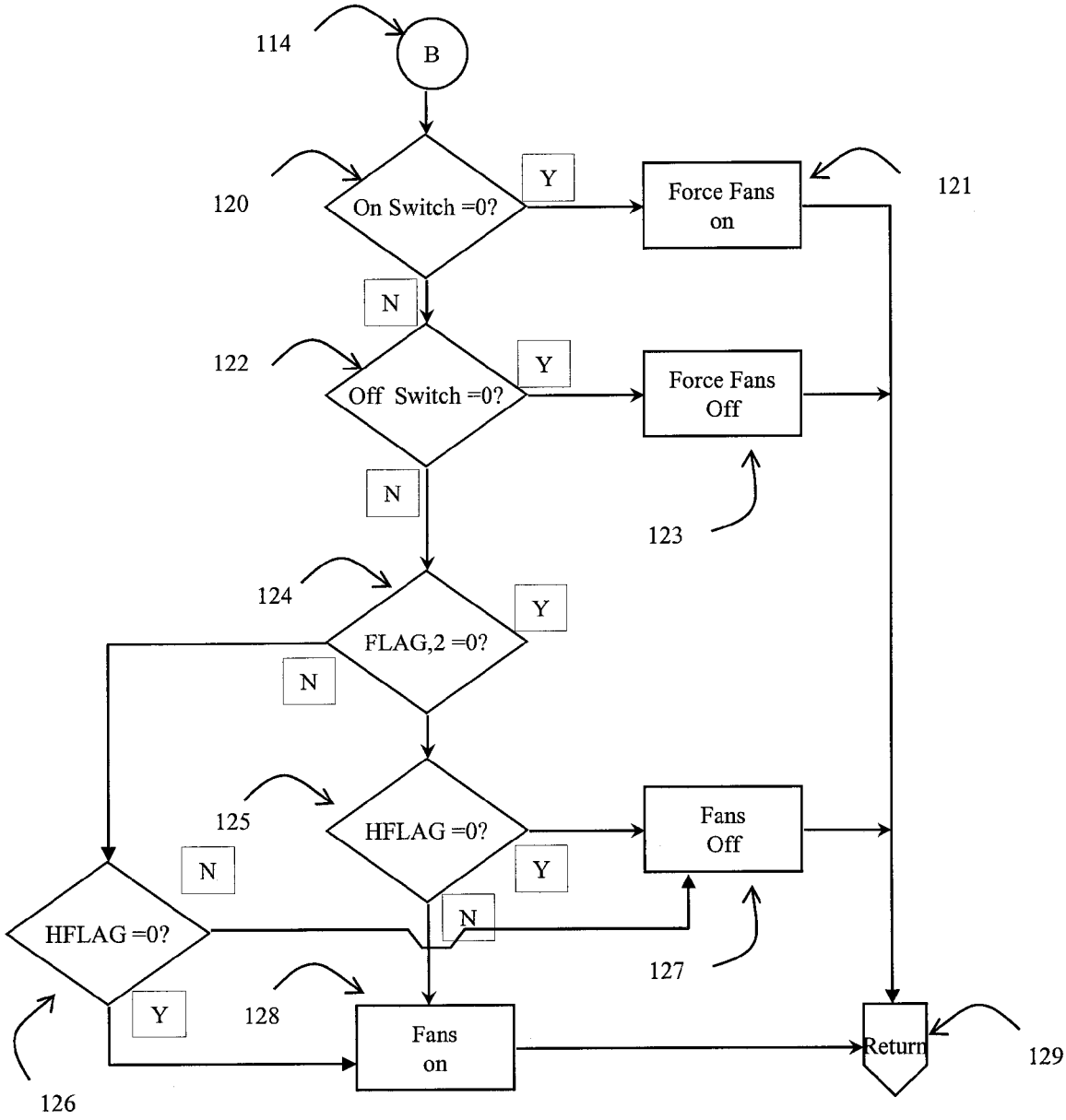
FIG. 10 is a flowchart of a second part of a Calcdiff subroutine.

The Calcdiff subroutine flow chart is shown in FIG. 9 and FIG. 10. Referring to FIG. 9, TAMB (ambient temperature of 25 degrees C.) is subtracted from TMAX1 in block 101. If the result in negative in block 102, it is reversed by block 103 to calculate TAMB−TMAX1, resulting in a positive difference stored in MAXDIFF (block 104). In Block 105, TMIN1−TAMB is calculated and if negative in block 106, is also revered by block 107 to produce a positive difference stored in MINDIFF at block 109. Block 108 calculates MAXDIFF−MINDIFF to determine which is the larger value in block 112. If MAXDIFF is larger, the HFLAG is cleared in block 111, signifying a heating cycle. If MINDIFF is larger, the HFLAG is set in block 112, signifying a cooling cycle. Again, the PEAKCOUNT is checked to see if it is equal to three in block 113 and if not, the subroutine returns via block 115, not taking any action on the Fans 6. If the PEAKCOUNT is equal to three, it continues to FIG. 10. The algorithm checks the ON switch in block 120. If it is set to zero, the user has requested the fans 6 to run all the time and they are forced "on" in block 121 and returns via block 129. Likewise, if the OFF switch is a zero, the fans are forced off in block 123 and returns via block 129. However, if neither switch is set to zero, the algorithm continues to check FLAG,2 in block 124 to determine if the Tmax transition called the subroutine, or the Tmin transition called the subroutine. IF FLAG,0 is not set, the HFLAG is checked in block 126. If it is zero, the fans 6 are turned on in block 128. If HFLAG is not zero, the fans 6 are turned off in block 127. Likewise, the FLAG,0 is set in block 124, then if HFLAG is zero in block 125, then the fans are turned off in block 127. If HFLAG is not zero in block 125, the fans 6 are turned on in block 128. After any of the above actions are completed, the subroutine returns via block 129.

As described above, the algorithm repeats approximately every two seconds.

Further, the temperature in the average air-conditioning unit 1 rises during active heating at least one degree per every ten seconds and falls at least one degree every ten seconds during active cooling until the steady-state is reached. When the air-conditioning unit 1 is turned off for long periods of time, the measured temperature can drift many degrees due to external factors like night cooling or day heating, causing the exemplary air-conditioning register assembly 5 to "see" a false transition and turn the fans 6 on as a result of incorrectly determining that the air-conditioning unit is providing conditioned air. However, the temperature change resulting from a temperature "drift" is much slower that the heating or cooling cycle changes. The drift compensation method described herein tracks the slow changing temperatures and prevents the register assembly 5 from identifying a false transition due to temperature drift. The drift can occur in both heating and cooling situations, but the drift compensation method works identically in either case, so only the heating cycle will be described here.

Figure 11:
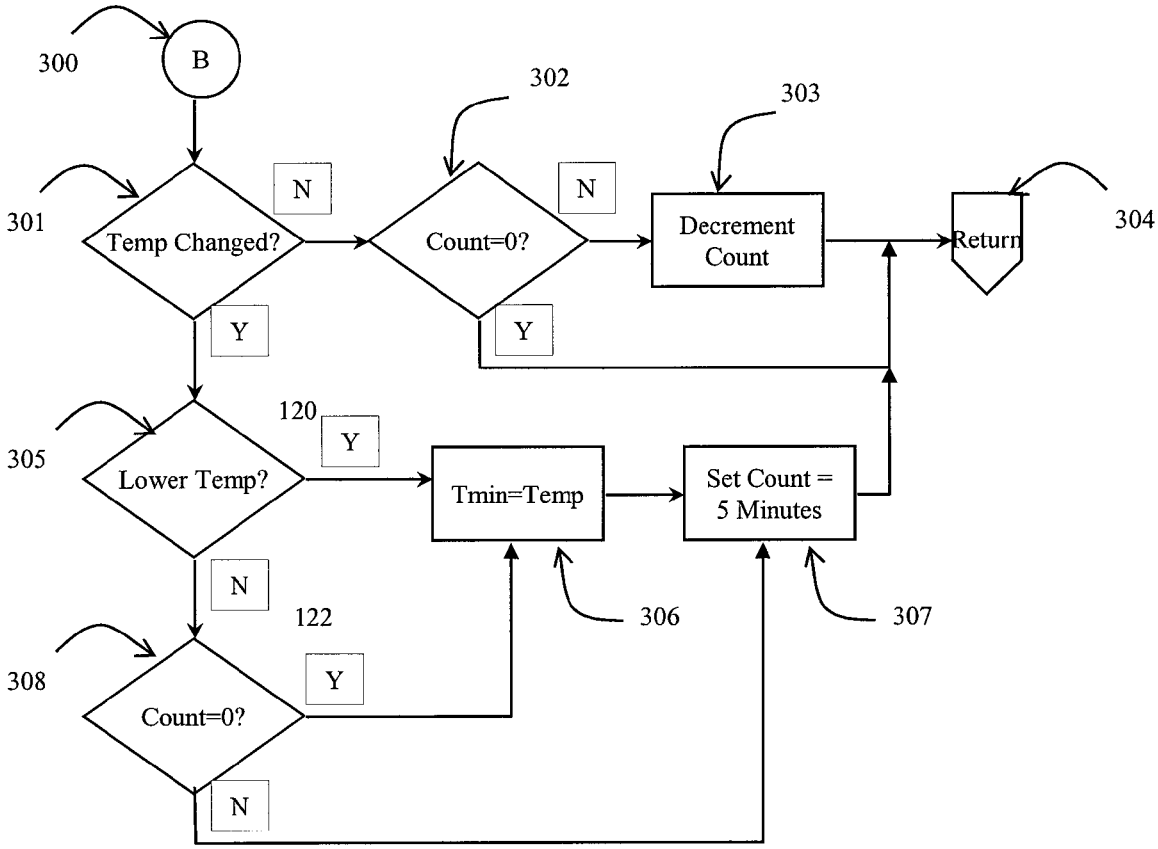
FIG. 11 is a flowchart of an exemplary drift compensation algorithm for performing the steps of a drift compensation algorithm.

FIG. 11 shows a flow chart of an exemplary drift compensation algorithm for performing the steps of the drift control method. The entry point 300 is entered into at least once per second in operation of the air-conditioning register assembly 5. First, the current temperature is compared to the last read temperature in decision block 301. If the temperature has not changed, the count is checked in block 302 to see if it is zero. (Five minutes will be used for this example. The time may be more or less than five minutes, but is much slower that the normal operation of the air-conditioning unit 1. Therefore, a zero count signifies that at least five minutes has passed without a temperature change.) If the count is zero, the program is returned to the calling program via block 304. If it is not zero, the count is decremented one second and then the program is returned to the calling program via block 304.

If the temperature has changed in block 301 since the last time it was read, block 305 determines if the temperature has risen or fallen from the last recorded temperature. If the temperature has fallen, the Tmin value is updated to the new temperature in block 306, the count is set back to five minutes, and the program is returned to the calling program via block 304.

If the temperature in block 305 has risen from the previous temperature reading, the count is checked in block 308 to determine if it is zero. If the count is zero, at least five minutes has passed since the temperature changed last. If the count is zero, the Tmin value is updated with the new rising temperature value in block 306 thus tracking it up or providing compensation, the count is reset to five minutes in block 307, and the program is returned to the calling program via block 304. If the count is not zero in block 308, signifying that the temperature change occurred in less than five minutes, Tmin is not updated (normal operation), the count is set back to five minutes, and the program is returned to the calling program via block 304.

Figure 12:
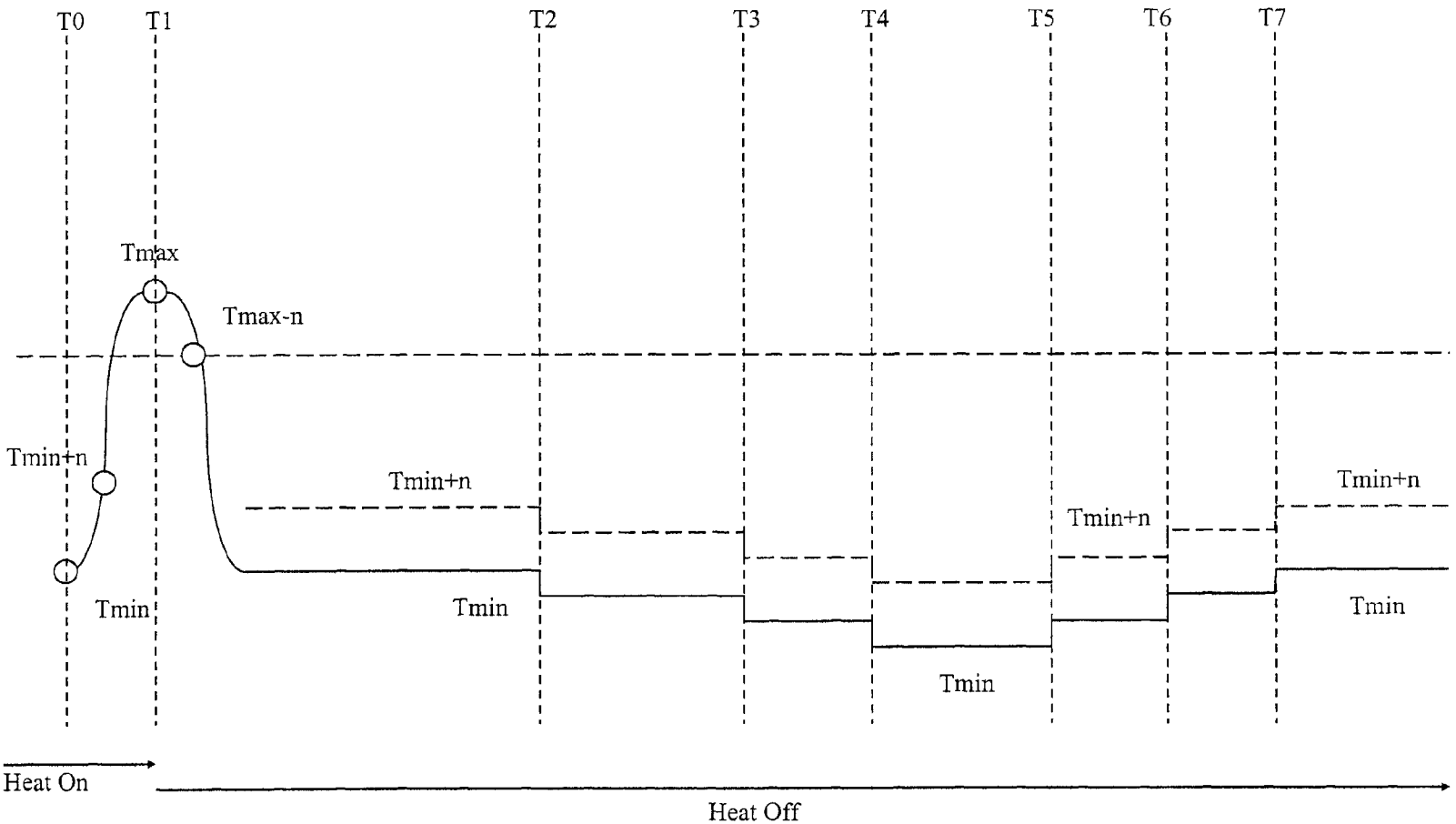
FIG. 12 is a graph of the operation of an exemplary air-conditioning register assembly with drift compensation for a heating cycle of an air-conditioning unit.

FIG. 12 shows the drift compensation method in operation for a heating cycle of a conventional home furnace. At time T0, the furnace turns on and begins heating. Because it is heating at more than one degree every 10 seconds, much less time than five minutes, the Tmin is not compensated as the temperature begins to rise. When the temperature exceeds Tmin+n, the processing means 8 senses it is time to turn on the fans for normal operation. At some time later, T1, the air-conditioning unit 1 senses that the room temperature has risen above the point set by the thermostat and begins cooling off, the temperature dropping rapidly as shown, again much faster than one degree every five minutes. At Tmax−n, the processing means 8 sets Tmin equal to the current temperature, and Tmin follows the temperature down, looking for the minimum value. If the furnace is turned off at this point, the temperature begins to slowly drift down due to colder outside air. At time T2, more than five minutes since the last temperature change, the temperature lowers one degree as shown. The normal method is to follow the temperature down to find Tmin, so at Times t3, and t4, Tmin is updated to the new minimum value. At some time, the outside air begins to warm back up, causing the temperature in the inactive air-conditioning unit 1 to slowly rise. At time T5, more than five minutes from time T4, the temperature rises one degree. Since it has been longer than five minutes, Tmin will be incremented to follow the temperature up as long as it is at least five minutes between temperature changes, as shown at times T6 and T7. If the furnace is activated at any time during the cycle, Tmin will not follow the rising temperature up because the temperature will begin to change rapidly, much faster that one degree every five minutes, and the register assembly 5 will operate as described above.

One of ordinary skill in the art will recognize that additional steps and configurations are possible without departing from the teachings of the invention. This detailed description, and particularly the specific details of the exemplary embodiment disclosed, is given primarily for illustration and no unnecessary limitations are to be understood therefrom, for modifications will become evident to those skilled in the art upon reading this disclosure and may be made without departing from the spirit or scope of the claimed invention.

What is claimed is:

1. A register assembly for augmenting the flow of conditioned air from a central air-conditioning unit to a room comprising:

at least one fan operably positioned for increasing air flow through said register assembly;

a temperature sensor for measuring a temperature of air in said register assembly and for outputting a measured temperature signal; and a processing means for:

receiving said measured temperature signal;

using said measured temperature signal in determining whether said central air-conditioning unit is providing conditioned air to said room;

activating said fan to augment said conditioned air flow if said central air-conditioning unit is providing conditioned air to said room; and providing drift compensation to prevent unwanted operation of said fan due to temperature drifts;

wherein said processing means determines whether said central air-conditioning unit is providing conditioned air to said room by:

monitoring said measured temperature signal for a maximum value, a minimum value, and transition values characteristic of a conditioned air cycle;

determining whether the central air-conditioning unit is in a heating mode or a cooling mode;

determining that said central air-conditioning unit is providing conditioned air to said room when the central air-conditioning unit is in a heating mode and the measured temperature signal transitions from a minimum value to a value that is a predetermined amount more than said minimum value, and when the central air-conditioning unit is in a cooling mode and the measured temperature signal transitions from a maximum value to a value that is a predetermined amount less than said maximum value;

determining that said central air-conditioning unit is not providing conditioned air to said room when the central air-conditioning unit is in a heating mode and the measured temperature signal transitions from a maximum value to a value that is a predetermined amount less than said maximum value, and when the central air-conditioning unit is in a cooling mode and the measured temperature signal transitions from a minimum value to a value that is a predetermined amount more than said minimum value;

wherein said processing means determines whether the central air-conditioning unit is in a heating or cooling mode by:

determining that said central air-conditioning unit is in a heating mode when the difference between said maximum value and a fixed ambient temperature value is greater than the difference between said minimum value and said fixed ambient temperature value; and determining that said central air-conditioning unit is in a cooling mode when the difference between said minimum value and said fixed ambient temperature value is greater than the difference between said maximum value and said fixed ambient temperature value; and wherein said processing means provides drift compensation by:

ascertaining that said measured temperature signal is a value that has changed from the previous measured temperature signal value and that said previous measured temperature signal value had remained constant for a predetermined amount of time, and then:

setting the minimum temperature value to said measured temperature signal value when said previous measured temperature signal value was the minimum temperature value and the measured temperature signal value is higher than said previous minimum temperature value; and setting the maximum temperature value to said measured temperature signal value when said previous measured temperature signal value was the maximum temperature value and the measured temperature signal value is lower than said previous maximum temperature value.

2. The register assembly of claim 1, wherein said processing means is further for:

using said measured temperature signal in determining whether said central air-conditioning unit is not providing conditioned air to said room; and deactivating said fan if said central air-conditioning unit is not providing conditioned air to said room.

3. The register assembly of claim 2, further comprising:

a rectangular housing positioned around said fan, temperature sensor, and processing means, said rectangular housing having side walls, an upper flange extending outward along a top edge of said side walls, and a bottom flange extending inward along a bottom edge of said side walls, said bottom flange supporting said fan, said side walls defining a rectangular cavity;

a screen sandwiched between said bottom flange and said fan; and a rectangular shaped top member having a top flange extending outward from a top louvered surface and a rectangular boss extending below said top flange, said top flange mating with said housing upper flange, said rectangular boss mating with housing rectangular cavity.

4. The register assembly of claim 2, wherein said fan is a centrifugal fan, said register assembly further comprising a housing positioned around said centrifugal fan, temperature sensor, and processing means, said housing adapting a floor vent to said centrifugal fan.

5. A method for augmenting the flow of conditioned air from a central air-conditioning unit to a room, comprising:

receiving a measured temperature signal from a temperature sensor operably positioned to measure a temperature of air in an air-conditioning register assembly;

determining whether said central air-conditioning unit is providing conditioned air to said room using said measured temperature signal;

activating a fan operably positioned for increasing the flow of said conditioned air when said central air-conditioning unit is providing conditioned air to said room;

deactivating said fan when said central air-conditioning unit is not providing conditioned air to said room; and providing drift compensation to prevent unwanted operation of said fan due to long term temperature drifts;

wherein said step of determining whether said central air-conditioning unit is providing conditioned air to said room includes:

monitoring said measured temperature signal for a maximum value, a minimum value, and transition values characteristic of a conditioned air cycle;

determining whether the central air-conditioning unit is in a heating mode or a cooling mode;

determining that said central air-conditioning unit is providing conditioned air to said room when the central air-conditioning unit is in a heating mode and the measured temperature signal transitions from a minimum value to a value that is a predetermined amount more than said minimum value, and when the central air-conditioning unit is in a cooling mode and the measured temperature signal transitions from a maximum value to a value that is a predetermined amount less than said maximum value; and determining that said central air-conditioning unit is not providing conditioned air to said room when the central air-conditioning unit is in a heating mode and the measured temperature signal transitions from a maximum value to a value that is a predetermined amount less than said maximum value, and when the central air-conditioning unit is in a cooling mode and the measured temperature signal transitions from a minimum value to a value that is a predetermined amount more than said minimum value;

wherein said step of determining whether the central air-conditioning unit is in heating mode or a cooling mode includes:

determining that said central air-conditioning unit is in a heating mode when the difference between said maximum value and a fixed ambient temperature value is greater than the difference between said minimum value and said fixed ambient temperature value; and determining that said central air-conditioning unit is in a cooling mode when the difference between said minimum value and said fixed ambient temperature value is greater than the difference between said maximum value and said fixed ambient temperature value; and wherein said step of providing drift compensation comprises:

ascertaining that said measured temperature signal is a value that has changed from the previous measured temperature signal value and that said previous measured temperature signal value had remained constant for a predetermined amount of time, and then:

setting the minimum temperature value to said measured temperature signal value when said previous measured temperature signal value was the minimum temperature value and the measured temperature signal value is higher than said previous minimum temperature value; and setting the maximum temperature value to said measured temperature signal value when said previous measured temperature signal value was the maximum temperature value and the measured temperature signal value is lower than said previous maximum temperature value.

6. A non transitory computer readable medium having computer executable instructions for performing a method for augmenting the flow of conditioned air from a central air-conditioning unit to a room comprising the steps of:

receiving a measured temperature signal from a temperature sensor operably positioned to measure a temperature of air in an air-conditioning register assembly;

determining whether said central air-conditioning unit is providing conditioned air to said room using said measured temperature signal;

activating a fan operably positioned for increasing the flow of said conditioned air when said central air-conditioning unit is providing conditioned air to said room;

deactivating said fan when said central air-conditioning unit is not providing conditioned air to said room; and providing drift compensation to prevent unwanted operation of said fan due to long term temperature drifts;

wherein said computer executable instructions for determining whether said central air-conditioning unit is providing conditioned air to said room include computer executable instructions for:

monitoring said measured temperature signal for a maximum value, a minimum value, and transition values characteristic of a conditioned air cycle;

determining whether the central air-conditioning unit is in a heating mode or a cooling mode;

determining that said central air-conditioning unit is providing conditioned air to said room when the central air-conditioning unit is in a heating mode and the measured temperature signal transitions from a minimum value to a value that is a predetermined amount more than said minimum value, and when the central air-conditioning unit is in a cooling mode and the measured temperature signal transitions from a maximum value to a value that is a predetermined amount less than said maximum value; and determining that said central air-conditioning unit is not providing conditioned air to said room when the central air-conditioning unit is in a heating mode and the measured temperature signal transitions from a maximum value to a value that is a predetermined amount less than said maximum value, and when the central air-conditioning unit is in a cooling mode and the measured temperature signal transitions from a minimum value to a value that is a predetermined amount more than said minimum value;

wherein said computer executable instructions for determining whether the central air-conditioning unit is in a heating mode or a cooling mode include computer executable instructions for:

determining that said central air-conditioning unit is in a heating mode when the difference between said maximum value and a fixed ambient temperature value is greater than the difference between said minimum value and said fixed ambient temperature value; and determining that said central air-conditioning unit is in a cooling mode when the difference between said minimum value and said fixed ambient temperature value is greater than the difference between said maximum value and said fixed ambient temperature value; and wherein said computer executable instructions for providing drift compensation include computer executable instructions for ascertaining that said measured temperature signal is a value that has changed from the previous measured temperature signal value and that said previous measured temperature signal value had remained constant for a predetermined amount of time, and then:

setting the minimum temperature value to said measured temperature signal value when said previous measured temperature signal value was the minimum temperature value and the measured temperature signal value is higher than said previous minimum temperature value; and setting the maximum temperature value to said measured temperature signal value when said previous measured temperature signal value was the maximum temperature value and the measured temperature signal value is lower than said previous maximum temperature value.

* * * * *